United States Patent [19]

Hobbs

[11] Patent Number: 4,807,150

[45] Date of Patent: Feb. 21, 1989

[54] CONSTRAINT CONTROL FOR A COMPRESSOR SYSTEM

[75] Inventor: James W. Hobbs, Sweeny, Tex.

[73] Assignee: Phillips Petroleum Company, Bartlesville, Okla.

[21] Appl. No.: 914,694

[22] Filed: Oct. 2, 1986

[51] Int. Cl.[4] ..... G01F 1/00

[52] U.S. Cl. ..... 364/510; 415/11; 417/4; 417/19; 137/100

[58] Field of Search ..... 364/509, 510; 137/1, 137/8, 10, 805, 825, 100, 109; 417/4, 19, 20; 415/1, 11

[56] References Cited

U.S. PATENT DOCUMENTS

| | | | |
|---|---|---|---|
| 4,134,423 | 1/1979 | Mayer | 364/510 |
| 4,156,578 | 5/1979 | Agar et al. | 415/1 |
| 4,203,701 | 5/1980 | Abbey | 415/1 |
| 4,230,437 | 10/1980 | Bellinger et al. | 415/1 |
| 4,440,239 | 4/1984 | Evans | 175/5 |
| 4,464,720 | 8/1984 | Agarwal | 364/431.02 |
| 4,502,842 | 3/1985 | Currier et al. | 417/8 |
| 4,539,967 | 9/1985 | Nakajima et al. | 123/585 |
| 4,581,707 | 4/1986 | Millar | 364/509 |
| 4,581,946 | 4/1986 | Kanayama | 73/861.77 |
| 4,690,163 | 9/1987 | Steinemann | 137/8 |

*Primary Examiner*—Parshotam S. Lall
*Assistant Examiner*—Thomas G. Black
*Attorney, Agent, or Firm*—George E. Bogatie

[57] ABSTRACT

A supervisory computer for a centrifugal compressor control system is disclosed which manipulates the set point of a controller for a valve in a recycle line from the compressor systems outlet to inlet. The supervisory computer manipulates the set point so as to both prevent surging and substantially minimize the recycling of compressed gas. The computer first determines the surge flow limit for the compressor based on prestored data from the compressors manufacture performance curves such as constant speed compressor curves, and the actual speed of the compressor. The controller then outputs a set point signal which periodically moves the control valve in incremental amounts toward the fully closed position. The periodic movement towards the closed position continues until the flow is close to the surge flow limit, or until the actual deviation of the setpoint flow and the actual process flow exceeds a desired high limit for this deviation. When the constraints are exceeded the controller periodically moves the control valve toward the fully open position until the constraints are satisfied, and then the cycle repeats.

12 Claims, 3 Drawing Sheets

CONSTRAINT CONTROL FOR A COMPRESSOR SYSTEM

This invention relates to control of a compressor system. In one aspect it relates to method and apparatus for substantially increasing the operating efficiency of a centrifugal compressor system while minimizing the possibility of damage to the compressor due to surging.

Surging begins at the positively sloped section of the centrifugal compressor curve. This is illustrated in FIG. 1 at the point S of the 100% speed curve. This flow will insure safe operation for all speeds but some power will be wasted at speeds below 100% because the surge limit decreases at reduced speeds. Although an inaccurate surge control point can put the compressor into deep surge a conservative surge point results in useless recycling and wasted horsepower.

As is well known to those skilled in the art the most efficient compressor operation is one where the centrifugal compressor operates as close as possible to the surge line without actually going into surge. For multistage compressor systems, each compressor in the system must operate without going into surge.

Various schemes have been proposed for controlling the flow of gas in a recycle line connected between the discharge outlet and the suction inlet of a centrifical compressor system to insure an adequate flow through the compressor even under conditions when the process flow is impeded. Typically a minimum flow controller is employed which normally handles a process flow corresonding to a point such as point A in FIG. 1. The minimum flow controller will have a set point corresponding to a flow that will insure safe operation under all expected conditions such as at point C in FIG. 1. As used herein a "minimum flow controller" is a controller that manipulates a flow control valve in the centrifugal compressors recycle line in response to a measured flow set point which can be manually or automatically adjusted.

A minimum flow control scheme which has provided an effective solution to the aforementioned problems by utilizing a minimum flow set point close to the surge limit such as point B in FIG. 1 is disclosed in U.S. Pat. No. 4,230,437 issued Oct. 20, 1980 to R. M. Bellinger, et al, which is incorporated herein by reference. The control system disclosed by Bellinger, et al, both prevents surging and substantially minimizes the recirculation of gas. However the system disclosed in that patent requires the establishment of a valve position signal and utilization of a valve position controller and a high select circuit in addition to the minimum flow controller. It would be desireable to control the compressor without the valve position signal and its associated controller and select circuit.

It is thus an object of this invention to prevent surging of a centrifical compressor while substantially minimizing the recirculation of gas without requiring a valve position signal. It is a further object of this invention to control a two stage centrifical compressor without violating a process constraint imposed for a low limit of the suction flow of each stage. It is a still further object of this invention to control the compressor without violating an additional constraint for the deviation between the set point and the process measurement for the minimum flow controller.

In accordance with the present invention method and apparatus are provided wherein a computed set point for a minimum flow controller for a two stage centrifical compressor is incresed by an incremental amount for each execution of the computer control program if the suction inlet flow to the first stage or to the second stage is less than a low limit for that respective stage. Also the minimum flow controller set point is increased if the deviation between the minimum flow controller set point and the actual process flow is greater than a high limit. If none of the aforementioned conditions exist, the minimum flow control set point is decreased on each execution of the computer control program and in this manner the minimum flow set point is periodically reduced so that the minimum flow set point is moved close to the surge line for at least one of the compression stages.

Essentially in this control action small incremental changes are periodically repeated to automatically move the position of the minimum flow control valve toward a fully closed position until a process constraint is encountered. In this manner the set point for the minimum flow controller is set at a flow rate which results in a substantial minimization of the comprssed gas that is recycled to the suction inlet. In addition a constraint is imposed on the maximum deviation between the set point and the process measurement for the minimum flow controller. This controller should include proportional plus reset action and antireset windup. The deviation constraint prevents the possibility of sluggish response, which could occur if the process flow suddenly decreased while a high deviation existed. This is becuase in this situation reset control action would oppose the desired action until the flow measurement approached the set point. Thereby, the minimum flow controller provides rapid response to upsets under all anticipated process conditions.

Other objects and advantages will be apparent from the foregoing brief description of the invention and the claims as well as the brief description of the drawings which are briefly described as follows:

The invention is illustrated and described in terms of a two stage centrifugal compressor. However the invention is applicable to compressor systems having a single stage or more than two stages. The requirement being the availability of instruments to measure the process flow, the rpm and the inlet pressure, the outlet pressure, and the inner stage pressures, if any.

Figure 1:
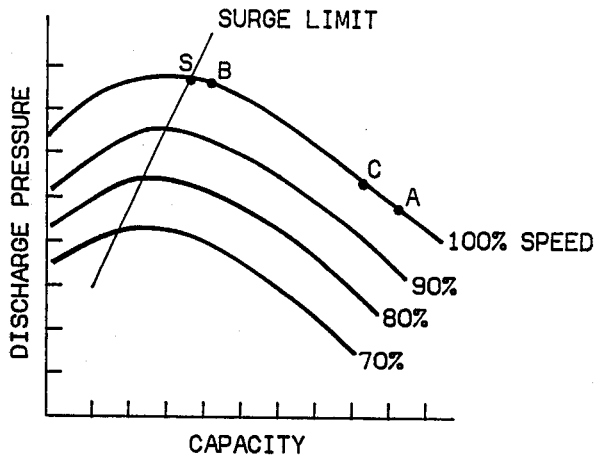
FIG. 1 is a typical family of constant speed curves for a centrifugal compressor.

A specific control system configuration is set forth in FIG. 1 for the sake of illustration. However, the invention extends to different types of control system configurations which accomplish the purpose of the invention. Lines designated as signal lines in the drawings are electrical or pneumatic in this preferred embodiment. Generally, the signals provided from any transducer are electrical in form. However, the signals provided from flow sensors will generally be pneumatic in form. Transducing of these signals is not illustrated for the sake of simplicity because it is well known in the art that if a flow is measured in pneumatic form it must be transduced to electrical form by a flow transducer. Also, transducing of the signals from analog form to digital form or from digital form to analog form is not illustrated because such transducing is also well known in the art.

The invention is also applicable to mechanical, hydraulic or other signal means for transmitting information. In almost all control systems some combination of electrical, pneumatic, mechanical or hydraulic signals will be used. However, use of any other type of signal transmission, compatible with the process and equipment in use, is within the scope of the invention.

A digital computer is used in the preferred embodiment of this invention to calculate the required control signal based on measured process parameters as well as set points supplied to the computer. Other types of computing devices could also be used in the invention. The digital computer used was an OPTROL 7000 Process Computer System from Applied Automation, Inc., Bartlesville, Okla.

Signal lines are also utilized to represent the results of calculations carried out in a digital computer and the term "signal" is utilized to refer to such results. Thus, the term signal is used not only to refer to electrical currents or pneumatic pressures but is also used to refer to binary representations of a calculated or measured value.

The controllers shown may utilize the various modes of control such as proportional, proportional-integral, proportional-derivative, or proportional-integral-derivative. The integral mode of a controller is often referred to as reset action. This is a control action which produces a corrective signal proportional to the length of time a controlled variable has been away from its set point. In this preferred embodiment, proportional-integral-derivative controllers are utilized but any controller capable of accepting two input signals and producing a scaled output signal, representative of a comparison of the two input signals, is within the scope of the invention.

Also the controller utilized in the preferred embodiment includes an anti-windup feature such that when an output or downstream module reaches a limit, the reset action is stopped. This provides for quick control recovery when the process variable comes back from its limiting condition.

The scaling of an output signal by a controller is well known in control system art. Essentially, the output of a controller may be scaled to represent any desired factor or variable. An example of this is where a desired flow rate and an actual flow rate is compared by a controller. The output could be a signal representative of a desired change in the flow rate of some gas necessary to make the desired and actual flows equal. On the other hand, the same output signal could be scaled to represent a percentage or could be scaled to represent a temperature change required to make the desired and actual flows equal. If the controller output can range from 0 to 10 volts, which is typical, then the output signal could be scaled so that an output signal having a voltage level of 5.0 volts corresponds to 50 percent, some specified flow rate or some specified temperature.

The various transducing means used to measure parameters which characterize the process and the various signals generated thereby may take a variety of forms or formats. For example, the control elements of the system can be implemented using electrical analog, digital electronic, pneumatic, hydraulic, mechanical or other similar types of equipment or combinations of one or more such equipment types. While the presently preferred embodiment of the invention preferably utilizes a combination of pneumatic final control elements in conjunction with electrical analog signal handling and translation apparatus, the apparatus and method of the invention can be implemented using a variety of specific equipment available to and understood by those skilled in the process control art. Likewise, the format of the various signals can be modified substantially in order to accommodate signal format requirements of the particular installation, safety factors, the physical characteristics of the measuring or control instruments and other similar factors. For example, a raw flow measurement signal produced by a differential pressure orifice flow meter would ordinarily exhibit a generally proportional relationship to the square of the actual flow rate. Other measuring instruments might produce a signal which is proportional to the measured parameter, and still other transducing means may produce a signal which bears a more complicated, but known, relationship to the measured parameter. Regardless of the signal format or the exact relationship of the signal to the parameter which it represents, each signal representative of a measured process parameter or representative of a desired process value will bear a relationship to the measured parameter or desired value which permits designation of a specific measured or desired value by a specific signal value. A signal which is representative of a process measurement or desired process value is therefore one from which the information regarding the measured or desired value can be readily retrieved regardless of the exact mathematical relationship between the signal units and the measured or desired process units.

Figure 2:
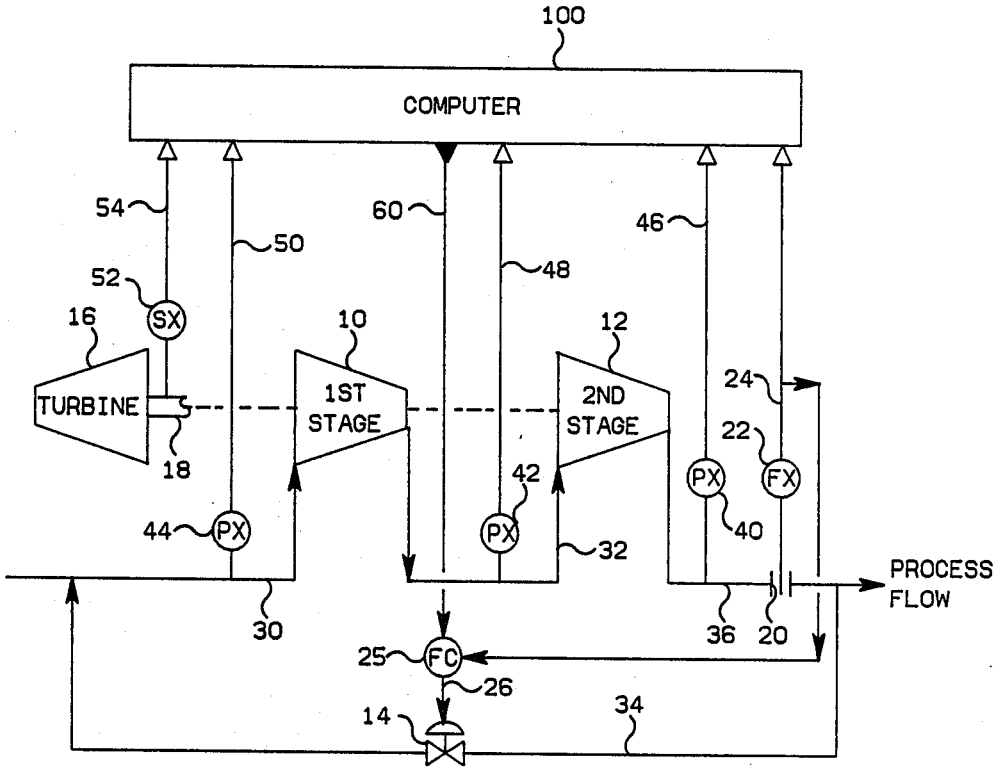
FIG. 2 is a diagramatic illustration of a two stage centrifugal compressor with the associated control system of the present invention.

Referring to the drawings and in particular to FIG. 2 there is illustrated a two stage centrifugal compressor system in which process gas is provided to the first stage compressor 10 through conduit means 30. Compressed gas from compressor 10 is passed to the second stage compressor 10 through conduit means 32. Compressed gas may be recycled from the discharge outlet of the second stage compressor 12 to the suction inlet of first stage compressor 10 through conduit means 34 by opening control valve 14 which is operably located in conduit means 34. The compressors are powered by a suitable drive means such as a turbine 16, the compressors 10 and 12 being connected to the source of power by any suitable means such as a rotating drive shaft 18.

The recycling of compressed gas from the discharge outlet of the second stage compressor 12 to the suction inlet to the first stage compressor 10 is controlled by utilizing the combination of flow sensor 20 and flow transducer 22 to provide an output signal 24 which is representative of the process gas flowing through conduit means 36. Signal 24 is provided as an input signal to flow controller 25 and is also provided as an input signal to computer 100. The flow controller 25 is also provided with a set point signal 60 which, as will be explained more fully hereinafter, is representative of the minimum flow rate of the gas flowing through conduit means 36. The flow controller 25 provides and output signal 26 which is responsive to the difference between signals 24 and 60. Control valve 14 is manipulated in response to signal 26 so as to maintain at least a minimum flow as represented by set point signal 60 in conduit means 36.

In general, control of the compressor system according to the present invention is accomplished by using a plurality of process measurements to establish a control signal. The process measurements will first be described, thereafter the manner in which the process measurements are utilized to generate the control signal will be described.

Pressure transducers 40, 42 and 44 in combination with pressure sensing devices operably located in conduits 36, 32 and 30 respectively, provide output signals 46, 48 and 50 respectively which are representative of the actual pressures in conduits 36, 32, and 30 respectively. Signals 46, 48 and 50 are provided as inputs to computer 100.

A speed transducer 52, which can be any suitable transducing means such as a tachometer associated with the turbine 16 or with the rotating shaft 18, as illustrated, provides an output signal 54 which is representative of the compressor speed. Signal 54 is provided from speed transducer 52 as an input signal to computer 100.

As previously stated signal 24 is provided from the flow transducer 22 as an input signal to computer 100.

In response to the above described inputs computer 100 provides an output control signal 60 which is representative of the minimum flow required in conduit means 36 to insure operation of the compressor system that is safe from surge disturbance. Signal 60 is provided from computer 100 as a set point signal for flow controller 25. It is noted that while the minimum flow for flow controller 25 is based on the measured flow in conduit means 36 it is also possible to base the minimum flow on measured flows in conduit means 30 or 32.

Figure 3:
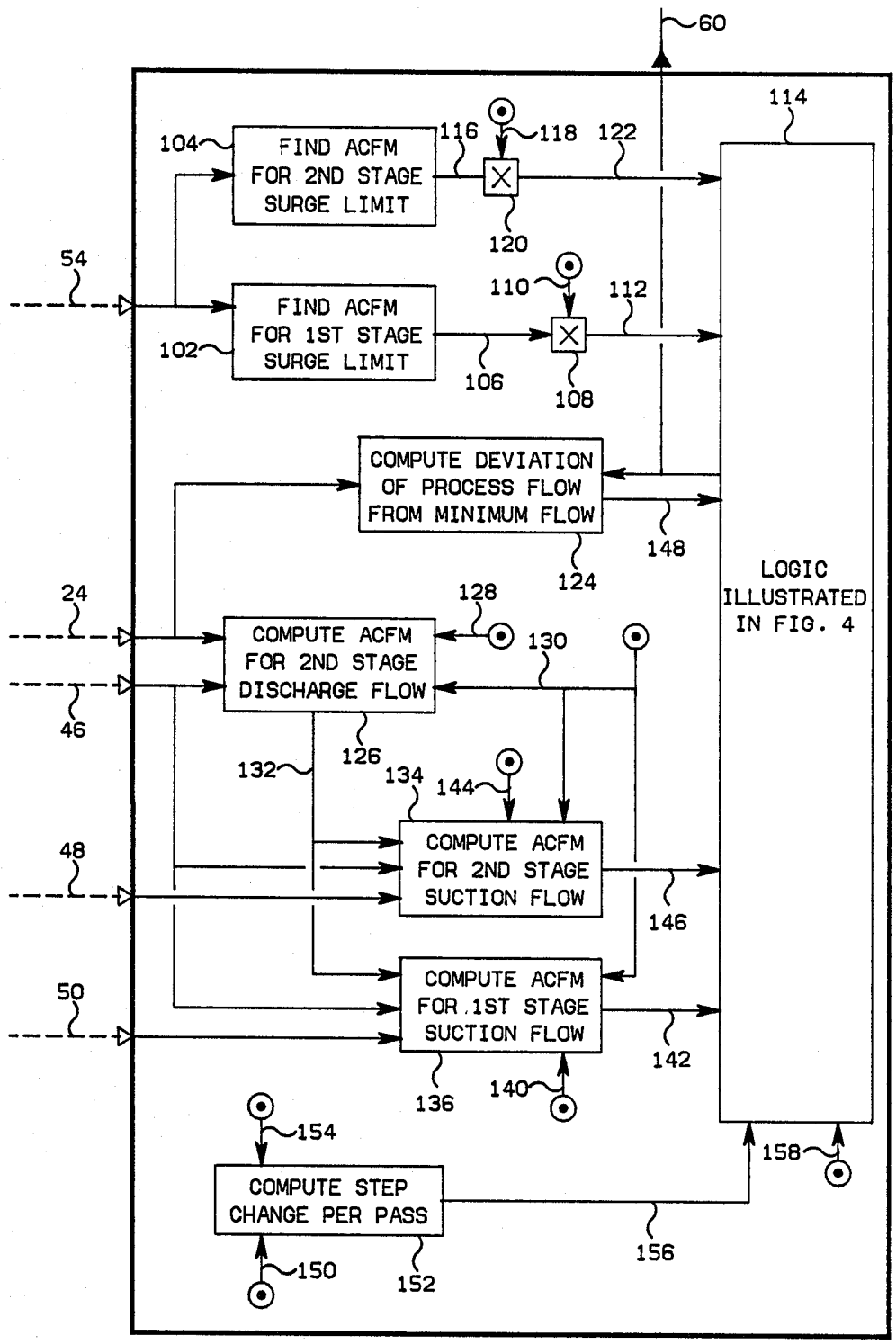
FIG. 3 is a representation of the computer logic suitable for the calculation of the process constraints and various flow rates.

The computer block diagram utilized to calculate control signal 60 in response to the previously described inputs is illustrated in FIG. 3. Referring now to FIG. 3, signal 54 which is representative of the speed of rotating shaft 18 which drives compressors 10 and 12 is provided to the "find ACFM for first stage surge limit" computer block 102 and to the "find ACFM for second stage surge limit" computer block 104.

If the compressor speed is known the actual cubic feet per minute (ACFM) for each compressor stage may be determined directly from the compressor manufactures performance curves such as the constant speed compressor curves illustrated in FIG. 1, for each compressor stage. For example the point S illustrated in FIG. 1. It is only necessary that the information relating compressor speed to the surge limit has been entered into the computer in a format which permits recovery of the the information. For example sets of related numbers for the speed and the corresponding flow for surge limit can be entered in the computer and the surge flow limit corresponding to the measured speed can be quickly found and retrieved. If desired interpolation between the entered points can be utilized to achieve a desired accuracy.

Computer block 102 provides an output signal 106 which is representative of the first stage flow corresponding to the surge limit for the measured speed. Signal 106 is provided from the computer block 102 as a first input to multiplying block 108. The multiplying block 108 is also supplied with signal 110 which is representative of a desired factor by which the actual low limit for the surge will exceed the actual surge limit. For example an operator may desire to maintain a minimum flow that is 110 percent of the surge limit to maintain a 10 percent safety factor. In this event signal 110 would be representative of 110 percent. Signal 108 is multiplied by signal 110 to establish signal 112 which is representative of the low limit for the suction flow of the first stage compressor. Signal 112 is provided from multiplying block 108 as a first input to logic block 114 for utilization as will be described hereinafter.

In a similar manner computer block 104 provides an output signal 116 which is representative of the second stage flow corresponding to the surge limit for the measured speed. Signal 116 is multiplied by signal 118 in multiplying block 120 which provides an output signal 122 representative of the low limit for the suction flow of the second stage compressor. Signal 122 is provided from multiplying block 120 as a second input to logic block 114. Signal 24 which is representative of the actual flow rate in standard cubic feed per day of the discharge outlet flow of the second stage compressor 12 flowing in conduit means 36 is provided to the "compute deviation of process flow from minimum flow" computer block 124 and to the "compute ACFM for second stage discharge flow" computer block 126. Computer block 126 is also supplied with signal 46 which is representative of the actual pressure of the second stage discharge outlet, and an operator entered signal 128 which is representative of the molecular weight of the process gas being compressed, and an operator entered signal 130 which is representative of the temperature for the second stage discharge. Gas temperature and molecular weight are assumed to be known and to remain substantially constant for a specific process.

In response to these described inputs computer block 126 calculates the actual cubic feet per minute for the second stage discharge flow in conduit means 36 in accordance with the following formula:

$$Q_{D2}=(F_{D2}/100)\,(11{,}193)\,(124.7/P_{D2})^{0.5}\,(11.05/CMW)^{0.5}\,(T_{D2}/711)^{0.5}$$

Where:

$F_{D2}$ = flow rate of second stage discharge as determined by transducer 22, MSCFD, $P_{D2}$ = discharge pressure for the second stage as measured by pressure transducer 40, PSIA, CMW = molecular weight of the process gas (assumed constant for a specific process), lbs./mol, $T_{D2}$ = temperature of gas discharge outlet of second stage (assumed constant for a specific process), °R, and where meter constants are:

100 = high range for flow meter 22, MSCFD, 11,193 = high range for flow meter 22, ACFM, 124.7 = flow meter 22 design pressure, PSIA, 11.05 = flow meter 22 design molecular weight, lbs./mol, and 711 = discharge temperature for meter design, °R.

The computer block 126 provides an output signal 132 which is representative of the actual cubic feet per minute flowing in the discharge outlet of second stage compressor 12. Signal 132 is provided from computer block 126 as an input to "compute ACFM for second stage suction flow" computer block 134, and to "compute ACFM for first stage suction flow" computer block 136. Computer block 136 is also provided with signal 50 which is representative of the actual pressure for the suction inlet of the first stage compressor, and with signal 46 which is representative of the actual discharge pressure for the second stage. Further computer block 136 is provided with operator entered signals 130 and 138 which are representative of temperatures at the discharge outlet of the second stage and the suction inlet of the first stage respectively. In response to the above described inputs computer block 136 calculates the actual cubic feet per minute for the first stage suction flow of compressor 10 in accordance with the following formula:

$$Q_{S1}32\ Q_{D2}=(P_{D2}/P_{Si})(T_{Si}/T_{D1})$$

Where:

$Q_{D2}$=second stage discharge flow, ACFM.

$P_{D2}$=discharge pressure for second stage as measured by pressure transducer 40, PSIA.

$P_{S1}$=discharge pressure for first stage suction as measured by pressure transducer 44, PSIA.

$T_{S1}$=temperature of gas at suction inlet of first stage, °R. (assume constant for a specific process)

$T_{D2}$=temperature of gas at discharge outlet of second stage, °R. (assume constant for a specific process)

Computer block 136 provides an output signal 142 which is representative of the actual flow rate for the suction flow of the first stage compressor 10. Signal 142 is provided from computer block 136 as a third input to logic block 114.

In a similar manner computer block 134 responds to signals 48, 46, and 132 which have been previously described, to provide an output signal 146 in accordance with the formula:

$$Q_{S2}=Q_{D2}(P_{D2}/P_{Si})(T_{S2}/T_{D2})$$

where the signals are as previously described.

Computer block 134 provides an output signal 146 which is representative of the actual flow rate for the suction flow of the second stage compressor 12. Signal 142 is provided from computer block 136 as a fourth input to logic block 114.

As previously stated signal 24 is provided to computer block 124. Signal 60 which is representative of the minimum flow rate of the gas flowing in conduit means 36 is also provided from logic block 114 to computer block 124. In computer block 124 signal 60 is subtracted from signal 24 to establish signal 148 which is representative of the deviation of the actual flow rate in conduit means 36 as represented by signal 24 from the minimum flow rate represented by signal 60. Signal 148 is provided from computer block 124 as a fifth input to logic block 114.

Signal 150 which is an operator entered signal representative of the time period in seconds per program pass is provided to the "compute step change per pass" computer block 152. As used herein a pass is defined as a single execution of a computer program which contains a number of subroutines. Stated another way signal 150 is representative of the time period between consecutive executions of a subroutine which calculates control signal 60 and thereby updates control signal 60 every time period. A value for signal 150 will generally be known. Signal 154 which is representative of the desired rate of change for control signal 60 in MSCFD/HR is provided to the computer block 152. It is noted that in practice of the present invention, changes in signal 154 can be utilized as a tuning adjustment for controller 25. In response to signals 150 and 154 computer block 152 calculates an increment by which control signal 60 is changed for each program pass in accordance with the following formula:

$$STEP=ISEC\ (FR/3600)$$

Where:

STEP=magnitude of increment change for control signal 60, MSCFD.

ISEC=seconds per program pass, seconds.

FR=rate of change for control signal 60, MSCFD/HR.

Signal 156, which is representative of the incremental change per program pass for control signal 60, is provided from computer block 152 as a sixth input to logic block 114. Signal 158, which is representative of a high limit for the deviation of the actual flow rate in conduit means 36 and the minimum flow rate represented by signal 60, is provided as a seventh input to logic block 114.

Figure 4:
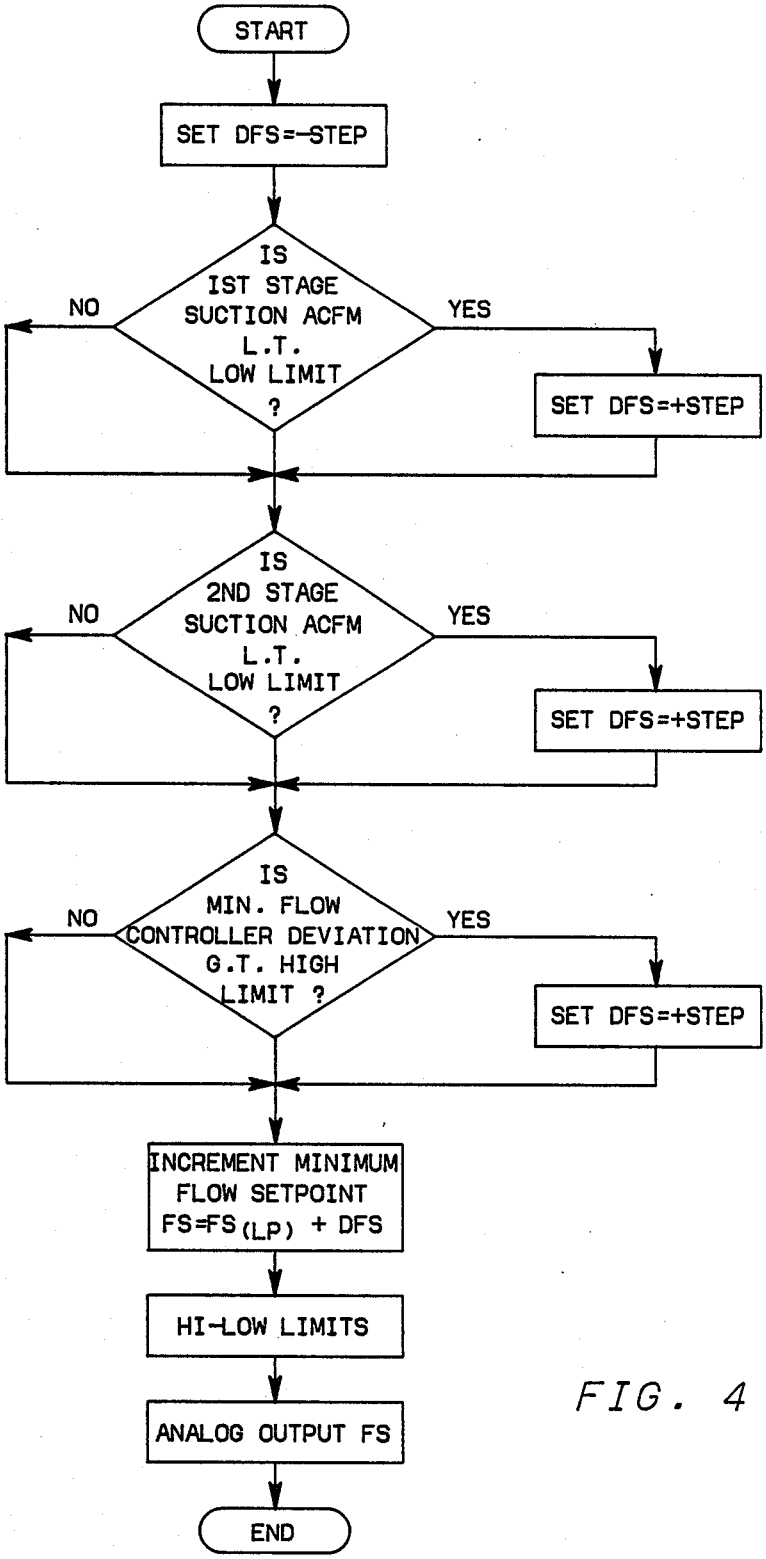
FIG. 4 is a logic flow diagram for the constraint control utilized to generate the set point for the minimum flow controller.

The various signals which are input to logic block 114 as illustrated in FIG. 3, are utilized in the logic diagram illustrated in FIG. 4 to determine an updated value for the set point signal 60. Symbols used in FIG. 4 are defined as follows:

DFS=change on minimum flow set point,

STEP=signal 156,

FS=updated value for signal 60, $FS_{(LP)}$=current value for signal 60, retained from last update, First stage suction=signal 142.

Low limit for first stage=signal 112.

Second stage suction ACFM=signal 146.

Low limit for second stage=signal 122.

Deviation=signal 148.

High limit for deviation=signal 158.

Referring now to FIG. 4 the subroutine first sets the term DFS=−STEP. This will cause signal 60 which is the set point for the minimum flow controller 25, to be decreased by the increment STEP unless a constraint is violated.

Next a determination is made as to whether a constraint for the low limit flow for the first stage suction has been violated. It is noted, however, that the order in which the determination for the various constraint is made is not critical. Further for a particular system it is not required to determine all of the constraints. For example it may be desireable to only consider the deviation constraint.

If the actual suction flow is less than its lower limit, DFS is said equal to +STEP. This will cause signal 60 to be increased by the increment STEP. If the low limit for first stage suction flow rate has not been violated DFS remains equal to −STEP.

Next the subroutine determines if a low limit for the second stage suction flow has been violated. Thus if the actual second stage suction flow is less than its low limit, DFS is set=+STEP. If DFS was set=+STEP for violation of the first stage suction flow, constraint violation of the second stage will have no further effect. If neither of the constraints for the low limit on suction flow are violated DFS will remain equal to −STEP.

Next a determination is made as to whether a constraint for the deviation of the minimum flow controller 25 has been violated. If the deviation is greater than its high limit the subroutine sets DFS=+STEP. In this manner the subroutine decreases the minimum flow set point on each pass unless a low limit constraint for the suction flow of either stage 1 or stage 2, or a high limit constraint for the deviation of flow controller 25 has been violated.

An updated value for signal 60 is then determined in the sub routine by setting $FS=FS_{(LP)}+DFS$. This will cause signal 60 to increase or decrease according to the value of DFS. It is noted that initially DFS is set equal to −STEP, however violation of any one or more of the three constraints will cause DFS to=+STEP.

Next the sub routine checks the signal FS against operated entered high and low limits. If signal 60 is less than a low limit, then signal 60 is set equal to the low limit. It is noted that generally for the initial execution of the subroutine the operator entered low limit signal will determine an initial value for signal 60.

The invention has been disclosed in terms of a preferred embodiment as illustrated in FIGS. 1–4. Specific components which can be utilized in the practice of the invention such as flow sensor 20, flow transducer 22, flow controller 25, pressure transducers 40, 42 and 44 and speed transducer 54 are each well known commercially available components such as are described at length in Perry's chemical engineers handbook, 5th edition, chapter 22, McGraw-Hill.

For reason of brevity convention axillary equipment normally associated with a compressor system such as interstage coolers, additional measurement and control devices, etc. have not been illustrated since they play no part in the explanation of the invention.

While the invention has been described in terms of the presently preferred embodiment reasonable variations and modifications are possible by those skilled in the art and such variations and modifications are within the scope of the described invention and the appended claims.

That which is claimed is:

1. Apparatus comprising:

(a) compressor means having a suction inlet and a discharge outlet;

(b) means for supplying a gas to the suction inlet of said compressor means;

(c) means for flowing the compressed gas from the discharge outlet of said compressor means and for recycling at least a portion of said compressed gas in a recycle stream from the discharge outlet to the suction inlet of said compressor means;

(d) means for establishing a first signal representative of the actual flow rate of the compressed gas through said compressor means;

(e) means for establishing a second signal representative of a desired minimum value for said actual flow rate represented by said first signal, wherein an initial value is established for said second signal and further wherein said second signal is a periodically updated signal having a current value and then one time period later having an updated value;

(f) means for comparing said first signal and the current value of said second signal to establish a third signal representative of the deviation of said first signal from the current value of said second signal;

(g) means for establishing a fourth signal representative of a high limit for the deviation represented by said third signal;

(h) means for comparing said third signal and said fourth signal to determine if a deviation constraint has been violated wherein an incremental value is added to the current value of said second signal to establish the updated value of said second signal if said third signal is greater than said fourth signal and wherein said incremental value is subtracted from the current value of said second signal to establish the updated value of said second signal if said fourth signal is greater than said third signal; and (i) means for manipulating the flow rate of said recycle stream in response to said updated value of said second signal.

2. Apparatus in accordance with claim 1 wherein said compressor means is a two-stage compressor having a first stage and a second stage and wherein said first signal is representative of the actual flow rate for the discharge flow of said second stage, said apparatus additionally comprising:

(j) means for establishing a fifth signal representative of a low limit flow rate for the suction flow of said first-stage;

(k) means for establishing a sixth signal representative of a low limit flow rate for the suction flow of said second stage;

(m) means for establishing a seventh signal representative of the actual flow rate for the suction flow of said first-stage;

(n) means for establishing an eighth signal representative of the actual flow rate for the suction flow of said second stage;

(p) means for comparing said fifth signal and said seventh signal to determine if a process flow constraint for said first stage has been violated, wherein said incremental value is added to the current value of said second signal to establish the update value for said second signals if said fifth signal is greater than said seventh signal unless said incremental value was previously added to the current value of said second signal in paragraph (h); and (q) means for comparing said sixth signal and said eighth signal to determine if a process flow constraint for said second stage has been violated wherein said incremental value is added to the current value of said second signal to establish the updated value for said second signal if said sixth signal is greater than said eighth signal unless said incremental value was previously added to the current value of said second signal in paragraph (h) or paragraph (p).

3. Apparatus in accordance with claim 2 additionally comprising:

means for establishing a ninth signal representative of a desired rate of change for said second signal;

means for establishing a tenth signal representative of a time period between consecutive executions of a subroutine for calculating said second signal in a computer means; and means for multiplying said ninth signal by said tenth signal to establish an eleventh signal representative of said incremental value.

4. Apparatus in accordance with claim 2 wherein said means for establishing said eighth signal comprises:

means for establishing a twelfth signal representative of the actual pressure at the discharge outlet of the said second stage;

means for establishing a thirteenth signal representative of the actual pressure at the suction inlet of said second stage;

means for establishing a fourteenth signal representative of the actual cubic feet per minute flow rate at the discharge outlet of said second stage; and means for establishing a fifteenth signal representative of the temperature of the gas at the discharge outlet of said second stage;

means for establishing a sixteenth signal representative of the temperature of the gas at the suction inlet of said second stage; and means for calculating said eighth signal based on said twelfth signal, said thirteenth signal, said fourteenth signal, said fifteenth signal and said sixteenth signal.

5. Apparatus in accordance with claim 2 wherein said means for manipulating the flow rate of said recycle stream in response to said second signal comprises:

a control valve means located in said recycle stream; and a controller for manipulating said control value means, wherein said controller has at least proportional and integral modes of operation and wherein said controllers is provided with said second signal for a set point signal.

6. Apparatus according to claim 1 wherein said compressor means is a single stage compressor, said apparatus additionally comprising:

means for establishing a fifth signal representative of a low limit for the suction flow of said compressor means;

means for establishing a sixth signal representative of the actual flow rate for the suction inlet of said compressor; and means for comparing said fifth signal and said sixth signal to determine if a process flow constraint has been violated, wherein said incremental value is added to the current value of said second signal to establish the updated value of said second signal unless said incremental value was previously added to the current value of said second signal in paragraph (h).

7. A method of controlling a compressor system in which a minimum flow controller and an associated control valve manipulate gas flow in a recycle stream from the discharge outlet to the suction inlet of said compressor system, said method comprising the steps of:

(a) establishing a first signal representative of an actual flow rate of compressed gas in said compressor system;

(b) establishing a second signal representative of a desired minimum value for said actual flow rate represented by said first signal wherein an initial value is established for said second signal and further wherein said second signal is a periodically updated signal having a current value and then one time period later having an updated value;

(c) comparing said first signal and the current value of said second signal to establish a third signal representative of the deviation of said first signal from the current value of said second signal;

(d) establishing a fourth signal representative of a high limit for the deviation represented by said third signal;

(e) comparing said third signal and said fourth signal to determine if a deviation constraint has been violated wherein an incremental value is added to the current value of said second signal if said third signal is greater than said fourth signal, and wherein said incremental value is subtracted from the current value of said second signal to establish the updated value of said second signal if said fourth signal is greater than said third signal; and (f) manipulating the flow rate of said recycle stream in response to said updated value of second signal.

8. A method in accordance with claim 7 wherein said compressor system is a two-stage compressor having a first stage and a second stage and wherein said first signal is representative of the actual flow rate for the discharge flow of said second stage, said method additionally comprising the steps of:

(g) establishing a fifth signal representative of a low limit flow rate for the suction flow of said first stage;

(h) establishing a sixth signal representative of a low limit flow rate for the suction flow of said second stage;

(i) establishing a seventh signal representative of the actual flow rate for the suction flow of said first stage;

(j) establishing an eighth signal representative of the actual flow rate for the suction flow of said second stage;

(k) comparing said fifth signal and said seventh signal to determine if a process flow constraint for said first stage has been violated, wherein said incremental value is added to the current value of said second signal to establish the updated value for said second signal if said fifth signal is greater than said seventh signal, unless said incremented value was previously added to the current value of said second signal in paragraph (e); and (l) comparing said sixth signal and said eighth signal to determine if a process flow constraint for said second stage has been violated wherein said incremental value is added to the current value of said second signal if said sixth signal is greater than said eighth signal, unless said incremental value was previously added to the current value of said second signal in paragraph (e) or paragraph (k).

9. A method in accordance with claim 8 additionally comprising:

establishing a ninth signal representative of a desired rate of change for said second signal;

establishing a tenth signal representative of a time period between consecutive executions of a subroutine for calculating said second signal in a computer means, and multiplying said ninth signal and said tenth signal to establish an eleventh signal representative of said incremental value.

10. A method in accordance with claim 9 additionally comprising the step of:

providing said second signal to said minimum flow controllers for a set point signal.

11. A method in accordance with claim 8 wherein said means for establishing said eighth signal comprises:

establishing twelfth signal representative of the actual pressure at the discharge outlet of said second stage;

establishing a thirteenth signal representative of the actual pressure at the suction inlet of said second stage;

establishing a fourteenth signal representative of the actual cubic feet per minute flow rate at the discharge outlet of said second stage;

establishing a fifteenth signal representative of the temperature of the gas at the discharge outlet of said second stage;

establishing a sixteenth signal representative of the temperatures of the gas at the suction inlet of said second stage; and if calculating said eighth signal based on said twelfth signal, said thirteenth signal and said fourteenth signal said fifteenth signal and said sixteenth signal.

12. A method in accordance with claim 7 wherein said compressor system is a single stage compressor, said method additionally comprising the steps of:

establishing a fifth signal representative of a low limit for the suction flow of said compressor;

establishing a sixth signal representative of the actual flow rate for the suction inlet of said compressor; and comparing said fifth signal and said sixth signal to determine if a process flow constraint has been violated wherein said incremental value is added to the current value of said second signal to establish the updated value of said second signal if said fifth signal is greater than said sixth signal, unless said incremental value was previously added to the current value of said second signal in paragraph (e).

* * * * *